US007589275B2

(12) United States Patent
Arimoto

(10) Patent No.: US 7,589,275 B2
(45) Date of Patent: Sep. 15, 2009

(54) ELECTRONIC HI-HAT CYMBAL

(75) Inventor: Keita Arimoto, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 746 days.

(21) Appl. No.: 11/132,596

(22) Filed: May 18, 2005

(65) Prior Publication Data

US 2005/0257672 A1 Nov. 24, 2005

(30) Foreign Application Priority Data

May 24, 2004 (JP) ..... 2004-154002
Jan. 27, 2005 (JP) ..... 2005-020037

(51) Int. Cl.
*G10H 3/00* (2006.01)

(52) U.S. Cl. ..... 84/723; 84/725; 84/730; 84/735; 84/422.1; 84/422.2; 84/422.3

(58) Field of Classification Search ..... None
See application file for complete search history.

(56) References Cited

U.S. PATENT DOCUMENTS

2005/0145102 A1* 7/2005 Susami ..... 84/735
2005/0150349 A1* 7/2005 Susami ..... 84/299

FOREIGN PATENT DOCUMENTS

JP 63-298394 A 12/1988
JP 06-035449 A 2/1994
JP 08-063160 A 3/1996
JP 2739414 B2 1/1998
JP 3059105 B2 4/2000

OTHER PUBLICATIONS

Japanese Notification of Reason(s) for Refusal mailed Mar. 3, 2009, for JP Patent Application No. 2005-020037, with English translation, four pages.

* cited by examiner

*Primary Examiner*—Marlon Fletcher
(74) *Attorney, Agent, or Firm*—Morrison & Foerster LLP

(57) ABSTRACT

An electronic hi-hat cymbal comprises a hi-hat having a strike detector, a pedal unit having a stepped degree detector, a waveform data memory for storing a plurality of electronic hi-hat sound waveform data, corresponding to respective stepped degrees, in a plurality of stages, a CPU, a musical tone generating controller, and so forth. The CPU causes the musical tone generating controller to read out electronic hi-hat sound waveform data corresponding to a stepped degree in the pedal unit from the waveform data memory when a strike to the hi-hat is detected to thereby generate a musical tone signal before outputting, and when a change occurs to the stepped degree during a musical tone being produced thereafter, to read out electronic hi-hat sound waveform data corresponding to a new stepped degree halfway through to thereby generate a musical tone signal to be outputted, which is continued while the musical tone is being produced.

11 Claims, 6 Drawing Sheets

ELECTRONIC HI-HAT CYMBAL

BACKGROUND OF THE INVEVTION

1. Field of the Invention

The invention relates to an electronic percussion instrument, and more particularly, to an electronic hi-hat cymbal for producing a musical tone of a hi-hat cymbal used in a drum set made up of acoustic musical instruments out of an electronic sound generated by an electronic tone generator.

2. Description of the Related Art

An electronic drum serving as an electronic percussion instrument is a percussion instrument wherein when a pad (head) of the electronic drum is struck with a stick (drumstrik) and so forth, a strike condition (stress, and so on) of the pad is detected by a strike sensor made up of a piezoelectric transducer, and so forth, provided on the back side of the pad, and an electronic sound is produced from an electronic tone generator based on a detection signal from the strike sensor. Further, with a plurality of electronic drums in combination, it is possible to make up an electronic drum set similar to an acoustic drum set made up of acoustic percussion instruments.

In the electronic drum set as well, use is made of an electronic hi-hat cymbal corresponding to a hi-hat cymbal (hereinafter referred to merely as a hi-hat) used in the acoustic drum set. The hi-hat of an acoustic percussion instrument is comprised of two cymbals, upper cymbal and lower cymbal, that are opened and closed by operation to step on a footpedal (hi-hat controller) provided as an accessory, and the upper cymbal is shifted up and down according to a stepped degree on the footpedal, thereby opening, and closing spacing between the two cymbals, so that a musical tone produced when the upper cymbal is struck with the stick undergoes variation.

For example, a clear musical tone (closed hi-hat) produced in a state where the footpedal is stepped down to the lowest position is used for rhythm-keeping while the closed hi-hat in combination with a stretched musical tone (open hi-hat) produced in a state where the footpedal is not stepped down is used for accentuation. Accordingly, in order to play music with the use of the electronic hi-hat in the same way as with the case of the hi-hat of the acoustic musical instrument, it is necessary to cause the electronic hi-hat to selectively produce a plurality of different electronic sounds as described above.

For that reason, in, for example, JP S63-298394 A, there has been disclosed a technology whereby an electronic percussion instrument in imitation of the hi-hat cymbal is provided with switches as two operations elements for use as a stick and footpedal respectively, and by the ON/OFF operations in combination, there are selectively produced a hi-hat closed sound in an operation condition 1 (ON/ON), a hi-hat foot musical tone in an operation condition 2 (OFF/ON) and a hi-hat open sound in an operation condition 3 (ON/OFF), as shown in, for example, FIG. 8.

Further, in, for example, JP H6-35449 A, there has been disclosed a technology whereby with another electronic percussion instrument in imitation of the hi-hat cymbal, an envelope of a musical tone to be outputted and tone color characteristics are controlled depending on a strike force against hi-hat pads, and a present manipulation position of a footpedal. Further, there has been disclosed a method of controlling the envelope whereby the maximum value of the envelope and time before reaching the maximum value are varied according to the strike force against the pads, and decay time is caused to change according to the manipulation position of footpedal.

In addition, there has been described an example of a method of controlling the tone color characteristics whereby a plurality of data on waveform (for example, data on the open hi-hat waveform, and data on the closed hi-hat waveform) are synthesized, thereby varying a mixing ratio thereof, and a filter factor for filtering the data on the waveform is varied.

With the electronic percussion instrument as the hi-hat cymbal, described in JP S63-298394 A, however, a strike sound corresponding to a combination of the ON/OFF conditions of the two operation elements at the time of occurrence of switch events (ON or OFF of the switch) is simply produced, so that it has been impossible to vary the strike sound even if the operation elements are operated for ON/OFF during occurrence of the strike sound. Consequently, it has been impossible to change a tone color, and so forth by operating the pedal after striking as in the case of actually playing the hi-hat.

Also, with the electronic percussion instrument as the hi-hat cymbal, described in JP H6-35449 A, during a musical tone being produced, it is also possible to cause the musical tone produced to undergo a change according to pedal manipulation information such as the position of the footpedal, time for returning the same to the original position, and so forth, however, since a method for implementing the above is simply to change the envelope of the original musical tone waveform, and change the mixing ratio of two musical tone waveforms, there has arisen a problem in that change in tone color becomes unnatural.

SUMMARY OF THE INVENTION

The invention has been developed to solve those problems described in the foregoing, and it is therefore an object of the invention to provide an electronic hi-hat cymbal capable of dynamically changing a hi-hat sound produced upon a strike by pedal manipulation at the time of the strike and after the strike in the same way as in the case of performance by a hi-hat cymbal of an acoustic percussion instrument, thereby enabling realistic performance to be expressed.

To that end, an electronic hi-hat cymbal according to the invention, comprises a hi-hat having a strike detector for detecting a strike, a pedal unit having a stepped degree detector for detecting a stepped degree of a pedal, a waveform data memory for storing a plurality of electronic hi-hat sound waveform data, corresponding to the respective stepped degrees, in a plurality of stages, detectable by the stepped degree detector, and a musical tone generator.

The musical tone generator reads out electronic hi-hat sound waveform data corresponding to a stepped degree detected by the stepped degree detector from the waveform data memory when a strike is detected by the strike detector to thereby generate a musical tone signal before outputting, and in the case where a change occurs to the stepped degree detected by the stepped degree detector during a musical tone being produced thereafter, the musical tone generator reads out electronic hi-hat sound waveform data corresponding to a new stepped degree halfway through to thereby generate a musical tone signal before outputting.

Further, a sound waveform of the electronic hi-hat is preferably a sound waveform with an amplitude envelope value decreasing in time sequence, and the musical tone generator is preferably configured such that when the electronic hi-hat sound waveform data are read out for the first time from the waveform data memory upon the detection of the strike, the electronic hi-hat sound waveform data are read out from the start thereof, and when a change occurs to the stepped degree during a musical tone being produced thereafter, electronic hi-hat sound waveform data corresponding to a new stepped degree is read out from an address of an amplitude envelope value corresponding to an amplitude envelope value of a sound waveform of the electronic hi-hat, being read at that point in time or from an address at the same position from the start in time sequence.

Further, the musical tone generator is preferably configured such that when a change occurs to the stepped degree during a musical tone signal being outputted, the musical tone signal is caused to fade out, thereby mixing a musical tone signal according to newly read electronic hi-hat sound waveform data therewith before outputting.

Still further, the musical tone generator may be configured such that if the stepped degree detected by the stepped degree detector falls between two adjacent stages among the plurality of stages, two sound waveform data corresponding to respective stepped degrees of the two adjacent stages are read out, and respective musical tone signals according to the two sound waveform data are mixed at a mixing ratio corresponding to the stepped degree detected before being outputted.

Yet further, if the strike detector is capable of detecting a strike strength as well, the musical tone generator may be configured so as to generate a musical tone signal by increasing or decreasing amplitude value of the sound waveform of the electronic hi-hat as read out, according to the strike strength detected by the strike detector.

Further, the stepped degree of a pedal, detected by the stepped degree detector, may be caused to correspond to an opening degree between two cymbals of a hi-hat cymbal of an acoustic percussion instrument, and the plurality of the electronic hi-hat sound waveform data stored in the waveform data memory may be electronic hi-hat sound waveform data equivalent to hi-hat strike sounds corresponding to the respective opening degrees between the two cymbals.

With the electronic hi-hat cymbal according to the invention, the plurality of the electronic hi-hat sound waveform data, to be generated, are stored so as to correspond to the respective stepped degrees, in the plurality of the stages, detectable by the stepped degree detector, and even when the pedal is manipulated in the middle of a musical tone of the electronic hi-hat being generated by striking the hi-hat, the electronic hi-hat sound waveform data are changed over in real-time response to a change in the stepped degree, so that the tone color, and envelope of a musical tone produced by a player undergo dynamic change, thereby enabling a realistic performance to be expressed.

The above and other objects, features and advantages of the invention will be apparent from the following detailed description which is to be read in conjunction with the accompanying drawings.

BRIEF DESCRIPTION OF THE DRAWINGS

FIG. 3 is a flow chart showing a process in the case of a first embodiment of the invention, executed by a CPU after the electronic hi-hat shown in FIG. 1 is turned ON;

FIG. 6 is a flow chart showing a process in the case of a second embodiment of the invention, executed by the CPU after the electronic hi-hat shown in FIG. 1 is turned ON;

DETAILED DESCRIPTION OF THE PREFERRED EMBODIMENTS

Preferred embodiments of the invention are specifically described hereinafter with reference to the accompanying drawings.

First Embodiment

Figure 1:
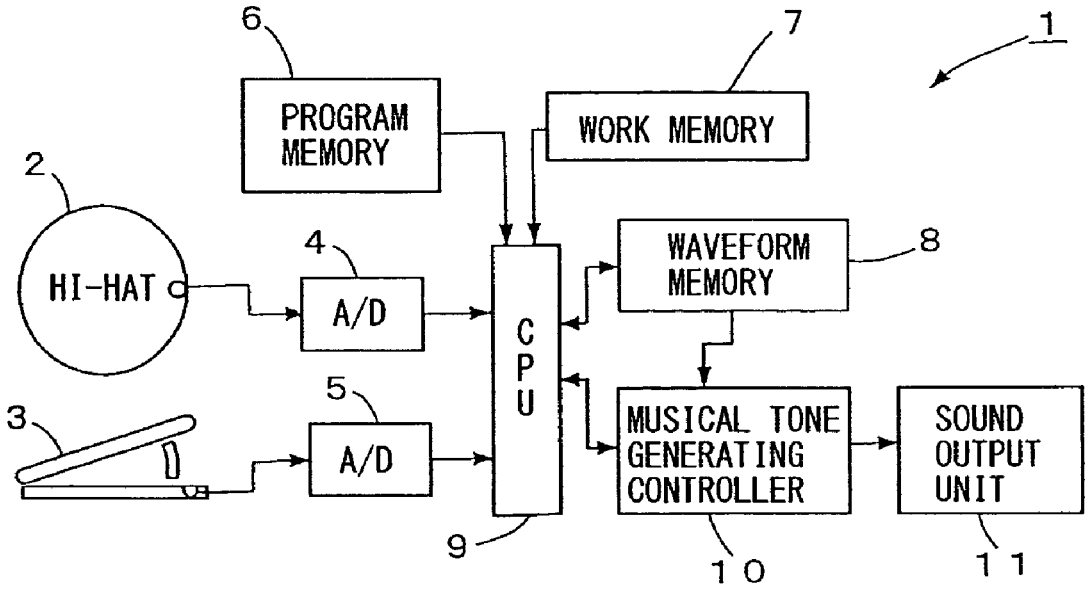
FIG. 1 is a block diagram showing a configuration in common with respective embodiments of an electronic hi-hat cymbal according to the invention.

First, a configuration in common with respective embodiments of an electronic hi-hat cymbal according to the invention is described with reference to FIG. 1. FIG. 1 is a block diagram broadly showing the configuration of the electronic hi-hat cymbal. As shown in FIG. 1, the electronic hi-hat cymbal (hereinafter referred to merely as "a hi-hat") 1 comprises a hi-hat 2, a pedal unit 3, A/D converters 4, 5, a program memory 6, a work memory 7, a waveform memory 8, a CPU 9, a musical tone generating controller 10, and a sound output unit 11.

In the hi-hat 2, the surface of a pad formed by fitting a rubber cover on the upper side of a metal base body circular in shape is used as a strike face, and a strike sensor made up of a piezoelectric transducer, and so on, serving as a strike detector, is provided on a side of the pad, opposite from the strike face. The strike sensor is capable of detecting magnitude of strike strength from an output voltage thereof while functioning as a trigger signal detector for detecting timing when the pad is struck with a stick. Further, the hi-hat 2 may be made up of a single pad, or made up of two pads in pairs, disposed above and below, respectively, in imitation of the hi-hat cymbal as an acoustic percussion instrument, thereby enabling clearance between the two pads to be opened and closed in interlocking motion with operation of the pedal unit 3.

The pedal unit 3 is provided with a footpedal having its one end axially supported, and capable of rotatably reciprocating, and the footpedal is always urged by a spring, or the like to move in an upward direction. Further, the pedal unit 3 is provided with a stepped degree detector for detecting stepped degrees on the footpedal, in a plurality of stages, comprising a membrane switch with a plurality of contacts connected in series, a pressing unit for sequentially and cumulatively turning the respective contacts of the membrane switch ON according to the respective stepped degrees on the footpedal, and a signal output circuit for increasing and decreasing an output voltage according to the number of the contacts turned ON by the pressing unit. Incidentally, for the stepped degree detector, use is not limited to the membrane switch, and use may be made of an angle sensor, such as a potentiometer, and so forth, a pressure sensor, a photo sensor, and so forth.

The A/D converters 4, 5 each are circuits for converting analog signals as detection signals outputted from the hi-hat 2, and the pedal unit 3, respectively, into respective digital signals that can be inputted to the CPU 9. The program memory 6 is a ROM storing a program that is decodable and executable by the CPU 9, and the work memory 7 is a RAM for temporarily storing various data, data being processed, and so forth, necessary for executing the program while the waveform memory 8 is a ROM for storing electronic hi-hat sound waveform data, to be described later on.

The CPU 9 is a controller for executing multiple-unit-control of operation of the electronic hi-hat cymbal 1 as a whole by reading the program stored in the program memory 6 to execute the same. Further, when a strike by the stick is detected by the strike sensor of the hi-hat 2, and when the pedal unit 3 is subsequently operated and the stepped degree on the footpedal as detected by the membrane switch undergoes a change, the CPU 9 selects the electronic hi-hat sound waveform data corresponding to the stepped degree, and causes the musical tone generating controller 10 to read the electronic hi-hat sound waveform data from the waveform memory 8, thereby generating a musical tone signal for a musical tone of the electronic hi-hat.

The musical tone generating controller 10 is a device that is controlled by the CPU 9, and reads designated electronic hi-hat sound waveform data from a designated address in the waveform memory 8, thereby generating the musical tone signal for the musical tone of the electronic hi-hat, according to the designated sound waveform data before outputting to the sound output unit 11.

The sound output unit 11 is a sound system comprising an amplifier for amplifying the musical tone signal delivered from the musical tone generating controller 10, and effecting acoustic transduction of the same before generating a musical tone (musical tone of the electronic hi-hat) corresponding to the strike sound of a hi-hat cymbal, a speaker and so forth. In this connection, the electronic hi-hat 1 itself need not necessarily be provided with the sound output unit described, but may be instead provided with an output terminal such as a jack, thereby outputting the musical tone signal to a sound output unit externally provided.

With the first embodiment of the invention, the waveform memory 8 is a waveform data memory storing a plurality of the electronic hi-hat sound waveform data, corresponding to the respective stepped degrees on the footpedal, in the plurality of the stages, detectable by the stepped degree detector.

Further, when a strike is detected by the strike detector, the CPU 9, and the musical tone generating controller 10 generate a musical tone signal by reading electronic hi-hat sound waveform data corresponding to a stepped degree on the footpedal from the waveform data memory before outputting the musical tone signal, and when the stepped degree on the footpedal subsequently undergoes a change, function as a musical tone generator for continuously outputting a musical tone signal by reading electronic hi-hat sound waveform data corresponding to a new stepped degree on the footpedal from the waveform data memory.

The waveform memory 8 and the musical tone generating controller 10 make up a so-called tone generating circuit, and in description given hereinafter, a functional portion of the waveform memory 8 in combination with the musical tone generating controller 10 is also referred to merely as an tone generator.

Next, there will be described in detail the electronic hi-hat sound waveform data, stored by the waveform memory. First, the electronic hi-hat sound waveform data according to the first embodiment represent bases for musical tones of the electronic hi-hat, produced by the electronic hi-hat. More specifically, the electronic hi-hat sound waveform data are digital data structured by causing amplitude values of sound waveforms of the electronic hi-hat, at respective points in time, to be stored in such a way as to correspond to consecutive addresses in the waveform memory 8 in time sequence. Further, the electronic hi-hat sound waveform data are waveform data corresponding to respective stepped degrees on the footpedal, that is, respective waveforms of strike sounds at opening degrees between an upper cymbal and a lower cymbal in the hi-hat cymbal of the acoustic percussion instrument, varying in a plurality of stages, and the respective sound waveform data are stored in the waveform memory.

The electronic hi-hat sound waveform data may be artificially synthesized data, however, use may be made of digital waveform data prepared by actually varying the opening degrees between the upper cymbal and the lower cymbal in the hi-hat cymbal of the acoustic percussion instrument, in a plurality of stages, and sampling acoustic waveforms of strike sounds, in the respective stages.

Figure 2:
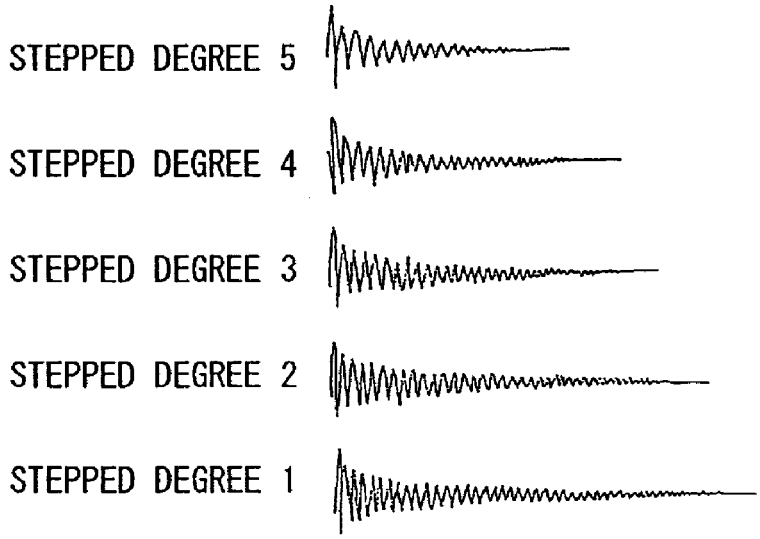
FIG. 2 is a waveform chart showing examples of sound waveforms of the electronic hi-hat of sound waveform data stored in a waveform memory, corresponding to respective stepped degrees on a pedal in a pedal unit.

FIG. 2 is a waveform chart showing examples of sound waveforms of the electronic hi-hat of sound waveform data stored in the waveform memory 8, corresponding to the respective stepped degrees, when the stepped degrees are divided in five stages. Those sound waveforms differ from each other in sustain time, that is, time from a strike until sound attenuation after decrease in sound amplitude in time sequence.

A stepped degree 1 represents a condition where the footpedal is not stepped down at all (corresponding to a condition where the hi-hat cymbal is open at the maximum), and the sound waveform of the electronic hi-hat, at that point in time, is the waveform of an open hi-hat sound, producing a stretched musical tone with the longest sustain time.

A stepped degree 5 represents a condition where the footpedal is stepped down at the most (corresponding to a condition where the hi-hat cymbal is closed at the maximum), and the sound waveform of the electronic hi-hat, at that point in time, is the waveform of a closed hi-hat sound, producing a sharp musical tone with the shortest sustain time.

Between the stepped degree 1 and the stepped degree 5, there are set intermediate stepped degrees 2, 3, 4, in three stages, providing respective sound waveforms of the electronic hi-hat, with sustain time being sequentially shortened.

Those waveforms not only differ from each other in sustain time, but also have frequency characteristics corresponding to the respective opening degrees between the upper cymbal and the lower cymbal, matching the stepped degrees, respectively. As described later on, changeover of those waveforms is executed at a position where an amplitude envelope value of the waveform data prior to the changeover, at the time of the changeover, becomes substantially equal to an amplitude envelope value of the waveform data after the changeover. The amplitude envelope value may be calculated on the basis of the waveform data every time the changeover is executed, or the amplitude envelope values of the respective waveform data may be calculated beforehand to be thereby stored.

Further, the amplitude envelope values may be stored as consecutive values corresponding to time positions of the waveform data, or the amplitude envelope values concerning a plurality of time positions, together with time information thereof, may be stored.

With the amplitude envelope values being stored, when changing over between electronic sound waveforms as described later on, comparison search of amplitude values, for dynamically connecting the sound waveforms together at the same amplitude envelope value, can be implemented with ease. The amplitude envelope value may be found from the average of absolute values of amplitudes or peak absolute values, in a predetermined time interval of the waveform data, and so forth.

Now, operation of the electronic hi-hat according to the first embodiment is described hereinafter. When the hi-hat 2 is struck with the stick, a stepped degree on the pedal of the pedal unit 3, at that point in time, is detected, and electronic hi-hat sound waveform data corresponding to the stepped degree are selected, thereby generating and producing a tone color corresponding to the stepped degree on the pedal, and a musical tone of the electronic hi-hat, in magnitude corresponding to strike strength in sustain time. Further, in the case where the stepped degree on the pedal of the pedal unit 3 is changed during the musical tone of the electronic hi-hat being produced, also the electronic hi-hat sound waveform data are changed over in real-time response to such a change, thereby causing the musical tone of the electronic hi-hat to change.

Figure 3:
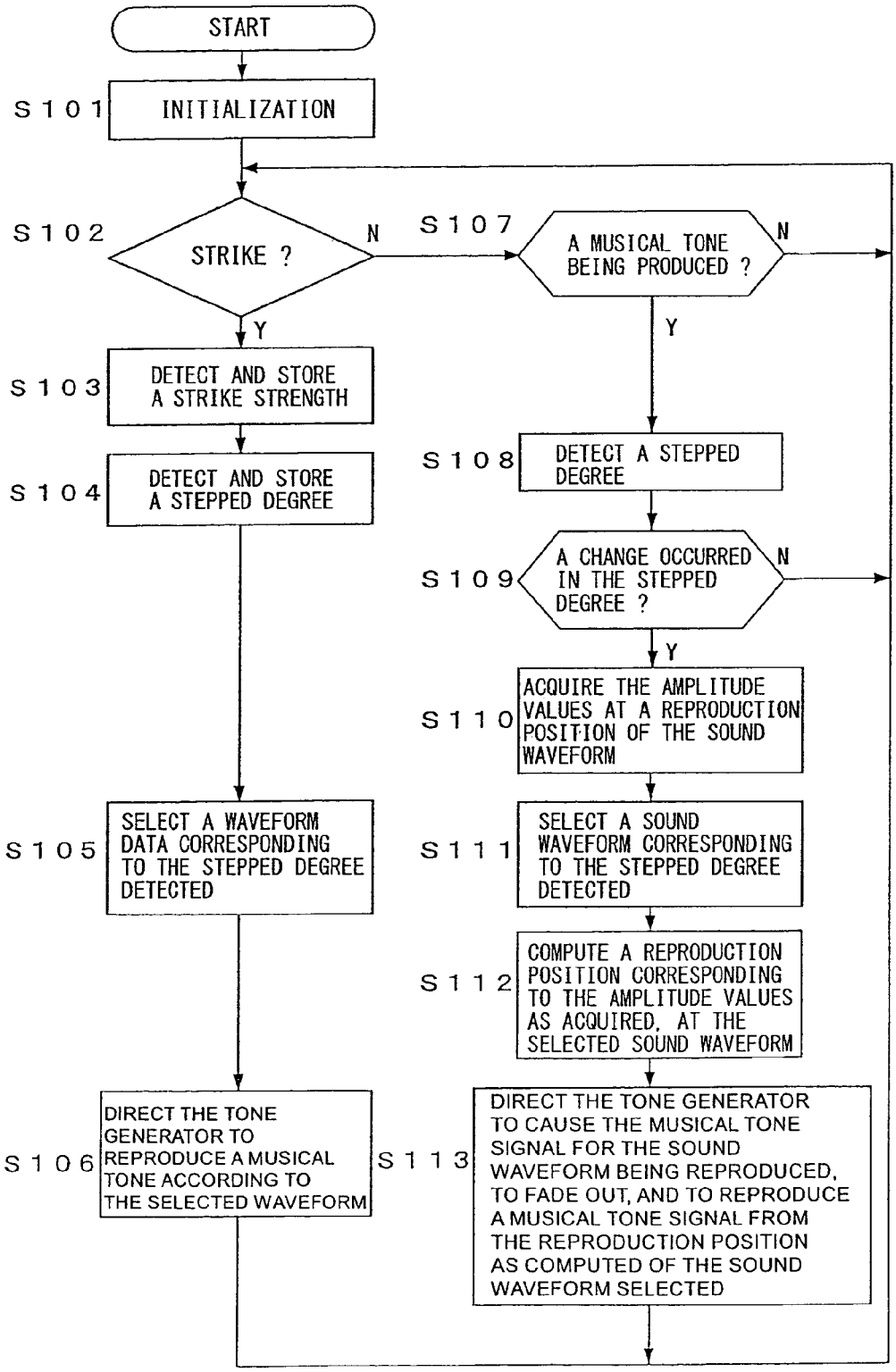

Sound-producing process by the electronic hi-hat described as above is described with reference to a flow chart in FIG. 3. FIG. 3 is the flow chart showing a process executed by the CPU 9 after the electronic hi-hat 1 shown in FIG. 1 is turned ON. The process shown in the flow chart indicates a process procedure by which the CPU 9 executes the process according to the program stored in the program memory 6. In the flow chart, respective steps of the process are described as S in abbreviation.

After the electronic hi-hat 1 shown in FIG. 1 is started upon the power being turned ON, the CPU 9 starts the process in the flow chart of FIG. 3. First, in a step 101, various parameters and data are initialized. At this point in time, while the respective units are initialized, the work memory 7 is caused to store initial values.

Next, the process proceeds to a step 102 to determine whether or not a strike has occurred to the hi-hat. More specifically, checking is made on whether or not there exists the detection signal (digital signal) delivered from the strike sensor of the hi-hat 2 via the A/D converter 4, that is, whether or not the detection signal is at not less than a predetermined value. When it is determined that the detection signal is at not less than the predetermined value, so that the strike has occurred, the process proceeds to a step 103 where a strike strength is detected on the basis of a value of the detection signal from the strike sensor, and is stored in the work memory 7. Then, in a step 104, a stepped degree of the pedal unit 3 is detected on the basis of the detection signal delivered from the pedal unit 3 via the A/D converter 5, and is stored in the work memory 7.

Thereafter, the process proceeds to a step 105 where electronic hi-hat sound waveform data corresponding to the stepped degree detected in the step 104 are selected, and in a step 106, the CPU 9 directs the tone generator (the musical tone generating controller 10 and the waveform memory 8) to read out the electronic hi-hat sound waveform data, as detected, and to generate a musical tone signal for a musical tone of the electronic hi-hat, thereby causing the sound output unit 11 to produce the musical tone (in the figure, this is paraphrased as "reproduce a musical tone according to the selected waveform" for simplification). In this case, the electronic hi-hat sound waveform data are read out from the start thereof, and an amplitude value is increased or decreased according to the strike strength, thereby providing the musical tone as produced with a stress.

By the process in the steps 103 to 106, a sound-produce-start process immediately after the strike is executed, and the sound-produce-start process is preferentially executed against the latest strike regardless of whether the process is in the middle of producing the musical tone caused by the strike occurred in the past, so that every time a strike occurs, such a strike will start producing a new musical tone of the electronic hi-hat, corresponding to a stepped degree on the footpedal, and a strike strength, at that point in time. Further, after execution of the sound-produce-start process, the electronic tone generator independently generates a musical tone signal, thereby causing the sound output unit 11 to continue producing a musical tone. In the meantime, the CPU 9 reverts to the step 102 to determine whether or not a strike has occurred to the hi-hat.

Now, process steps taken when it is determined in the step 102 that no strike has occurred are described hereinafter. In this case, the process proceeds to a step 107 to determine whether or not a musical tone is being produced. If not, the process reverts to the step 102, and remains in a standby state where no action is made before a strike is detected next time, repeating two determinations in loops of the step 102, and the step 107, respectively.

When it is determined that a musical tone is being produced in the step 107, the process then proceeds to a step 108 where a stepped degree in the pedal unit 3 is detected by the same process as in the step 104, and in a step 109, the latest stepped degree as detected is compared with the stepped degree as detected at the preceding time, and stored, thereby determining on whether or not a change has occurred in terms of the stage of the stepped degree on the pedal. When it is determined that no change has occurred, the process is to continue producing the present musical tone of the electronic hi-hat, reverting to the step 102.

Further, even if there has occurred a slight change in the actual stepped degree on the pedal, when this results in no change in terms of stepped degree ranking, such as the stepped degrees 1 to 5, as shown in FIG. 2, it is determined that no change has occurred.

Then, when it is determined in the step 109 that a change has occurred in terms of the stage of the stepped degree on the pedal, a switchover process for the sound waveform of the electronic hi-hat is executed in steps 110 to 113.

First, in the step 110, an amplitude envelope value at a reproduction position of the sound waveform of the electronic hi-hat, as read out by the tone generator at that point in time, is acquired, and the process proceeds to the step 111 where a sound waveform of the electronic hi-hat, corresponding to the latest stepped degree as detected in the step 108 is selected. Subsequently, in the step 112, a reproduction position corresponding to the amplitude envelope value as acquired in the step 110, at the sound waveform as selected, is computed as an address in the waveform memory 8.

Thereafter, in the step 113, the CPU 9 directs the tone generator to cause the musical tone signal of the sound waveform of the electronic hi-hat, being produced at present to fade out, and simultaneously to read out data on the electronic hi-hat sound waveform selected in the step 111 from the address computed in the step 112 to generate (reproduce) a new musical tone signal, thereby mixing both the musical tone signals together before producing a musical tone, and thereafter, the process reverts to the step 102.

With the switchover process for the sound waveform of the electronic hi-hat, as executed in the steps 110 to 113, the two sound waveforms of the electronic hi-hat, differing from each other, can be changed over in such a way as to be dynamically and smoothly connected with each other, so that it is possible to produce natural change in electronic hi-hat sound so as to correspond to variation in the stepped degree on the pedal.

Figure 4:
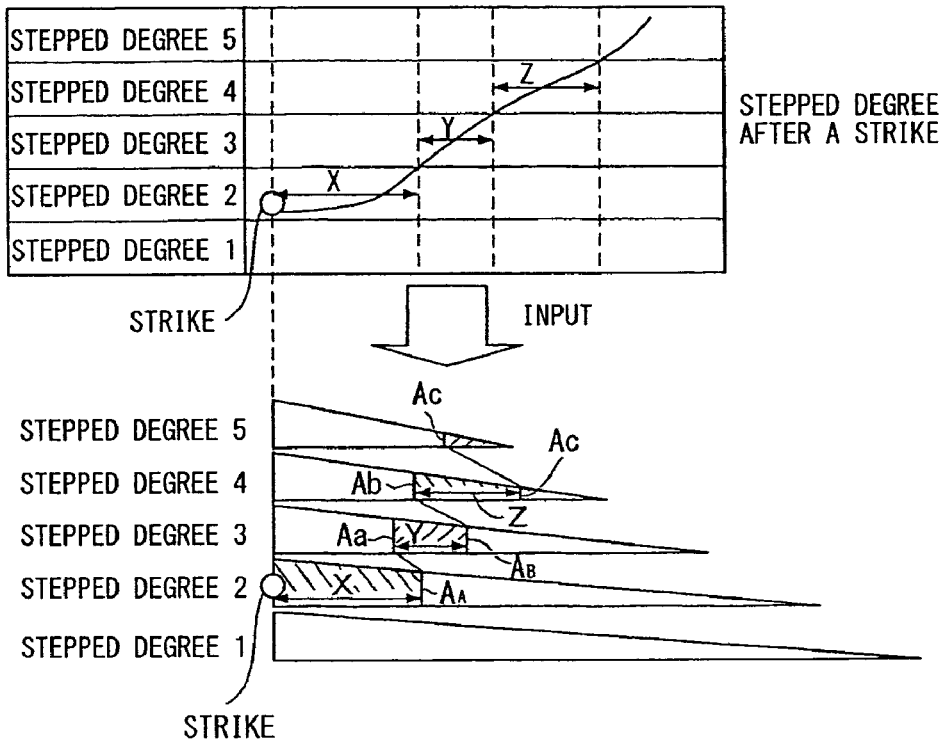
FIG. 4 is a schematic view illustrating changes in stepped degree in the pedal unit after a hi-hat of the electronic hi-hat shown in FIG. 1 is struck, and changeover actions of respective sound waveforms of the electronic hi-hat, according to such changes.
Figure 5:
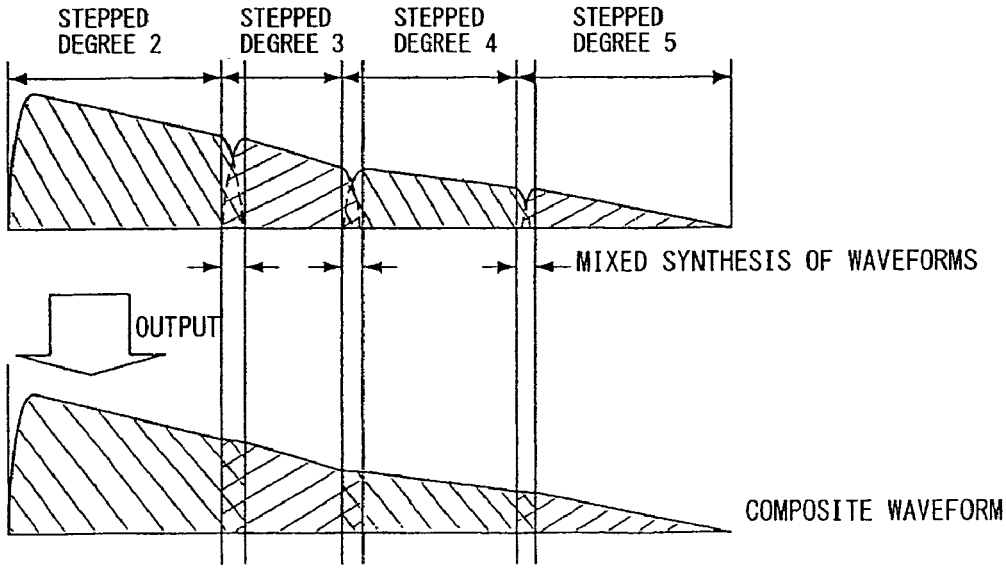
FIG. 5 is a schematic view illustrating synthesis connection of the respective sound waveforms of the electronic hi-hat, as changed over, in the case of the first embodiment described in FIG. 3.

Referring to FIGS. 4, and 5, the switchover process for the sound waveform of the electronic hi-hat will be described in detail hereinafter. FIG. 4 is a schematic view showing a relationship between changes in stepped degree, and reproduction positions of respective sound waveforms of the electronic hi-hat, changed over according to the changes, and FIG. 5 is a schematic view illustrating synthesis connection of the respective sound waveforms of the electronic hi-hat, as changed over. The waveforms shown in FIGS. 4, and 5, respectively, schematically indicate only an envelope waveform representing changes in magnitude of amplitude values.

In FIG. 4, the stepped degree is divided into 5 stages, and by way of example, there is shown a case where in x seconds after a strike is first given in the stage of the stepped degree 2, the stepped degree is changed to the stage of the stepped degree 3, and in y seconds from the stepped degree 3, the stepped degree is changed to the stage of the stepped degree 4, further being changed z seconds later to the stepped degree 5. During the process in the previously described step 110, against such inputs as above, respective amplitude envelope values $A_A$, $B_B$, $C_C$ of the sound waveforms of the electronic hi-hat, being produced at respective changeover times, are acquired, and during the process in the step 111, the respective sound waveforms of the electronic hi-hat, corresponding to the stepped degrees after the respective changes, are selected.

Further, during the process in the step 112, respective reproduction positions corresponding to amplitude envelope values Aa, Bb, Cc, equal in value, to the amplitude envelope values $A_A$, $B_B$, $C_C$, respectively, acquired as above, at respective sound waveforms of the electronic hi-hat, to be subsequently changed over, are computed as address data in the waveform memory.

Next, during the process in the step 113, as shown in FIG. 5, the respective sound waveforms of the electronic hi-hat, as selected, are read out from the addresses as computed to be thereby connected with each other, and further, a musical tone signal for the sound waveform of the electronic hi-hat, prior to changeover, is caused to fade out at the time of the changeover between the sound waveforms of the electronic hi-hat. Simultaneously, a musical tone signal for the sound waveform of the electronic hi-hat, to be subsequently changed over, is caused to fade in to thereby cause both the musical tone signals to undergo mixed synthesis (cross-fade synthesis), so that a musical tone signal of a composite waveform natural in amplitude value variation throughout can be generated, and produced.

In this connection, the fade-in of the musical tone signal, as described above, may be that at a level occurring in the case of allowing the musical tone signal to naturally rise. Further, even in the case of the process described as above, the electronic tone generator is set to output always by varying amplitude values at a predetermined variation ratio corresponding to a strike strength as stored.

As described in the foregoing, with the electronic hi-hat according the first embodiment, even in the case of operating the pedal during producing a musical tone of the electronic hi-hat after the hi-hat 2 is struck with the stick, a sound waveform of the electronic hi-hat, being produced, is changed over in real-time response to a change in stepped degree on the pedal, so that the tone color and envelope of musical tone produced undergo dynamic variation, thereby enabling a realistic performance to be presented.

With the first embodiment described as above, when changing over between sound waveforms of the electronic hi-hat, the waveforms are connected with each other at the same amplitude envelope value. However, new sound waveform data may be read from an address at the same position from the start in time sequence as that for sound waveform data producing a musical tone when the stepped degree on the pedal is changed to thereby change over to a musical tone signal for the new sound waveform data. By so doing, the switchover process for the sound waveform can be simplified although naturalness of connected parts is somewhat impaired.

Furthermore, with the first embodiment described as above, when changing over between the sound waveforms of the electronic hi-hat, both the musical tone signals are caused to undergo the mixed synthesis by the cross-fade synthesis, however, the sound waveforms may be connected by naturally changing over the musical tone signals with adoption of a scheme such as execution of fade-out only without execution of the fade-in, connection of the sound waveforms, at positions where actual amplitude values of the sound waveforms are the same instead of at the same amplitude envelope value, and so forth.

Second Embodiment

Next, there is described hereinafter a second embodiment of an electronic hi-hat cymbal according to the invention. The electronic hi-hat cymbal according to the second embodiment is the same in hardware configuration as the first embodiment. The second embodiment differs from the first embodiment only in respect of the process by the musical tone generating controller 10, and the CPU 9, making up the musical tone generator, and the program of the process, stored in the program memory 6, and only points of difference are therefore described. Otherwise, the second embodiment is the same in configuration, operation, and effect as the first embodiment, omitting therefore description thereof.

In FIG. 1, a musical tone generating controller 10 according to the second embodiment reads two sound waveform data as designated by a CPU 9 from respective designated addresses in a waveform memory 8, and mixes musical tone signals corresponding to musical tones of the electronic hi-hat, according to the two sound waveform data, at a mixing ratio designated by the CPU 9 to generate a musical tone before outputting to a sound output unit 11.

Further, with the second embodiment, a pedal unit 3 is provided with a membrane switch with a high resolution, capable of closely detecting stepped degrees on the pedal, otherwise a potentiometer or a photo sensor, capable of detecting the stepped degrees on the pedal on a continual basis. Then, stages of the stepped degrees corresponding to respective sound waveform data are set to respective position points, and if a stepped degree as detected after a strike is found to fall between two adjacent stage positions, the CPU 9 designates a mixing ratio corresponding to two sound waveform data corresponding to the respective stepped degrees in the two stages, addresses for reading out the same, and a ratio of differences between a position of the stepped degree as detected, and the respective stage-positions of the adjacent stepped degrees, above and below, to be subsequently delivered to the musical tone generating controller 10.

By doing so, even in the middle of the stepped degree after the strike being changed between the two adjacent stage-positions, musical tones of the electronic hi-hat, corresponding to the two sound waveform data, can be naturally changed over on a substantially continual basis, and furthermore, it is possible to faithfully reproduce even a delicate change in the stepped degree between the two adjacent stage-positions.

Still further, with the second embodiment, it is possible to execute a process for producing a foot-close sound (a musical tone produced by clapping hard upper and lower cymbals in the case of an acoustic percussion instrument) differing from a strike sound produced when struck with a stick by detecting a foot-close operation for stepping down hard the pedal of the pedal unit 3 fully to the lowest position.

Figure 6:
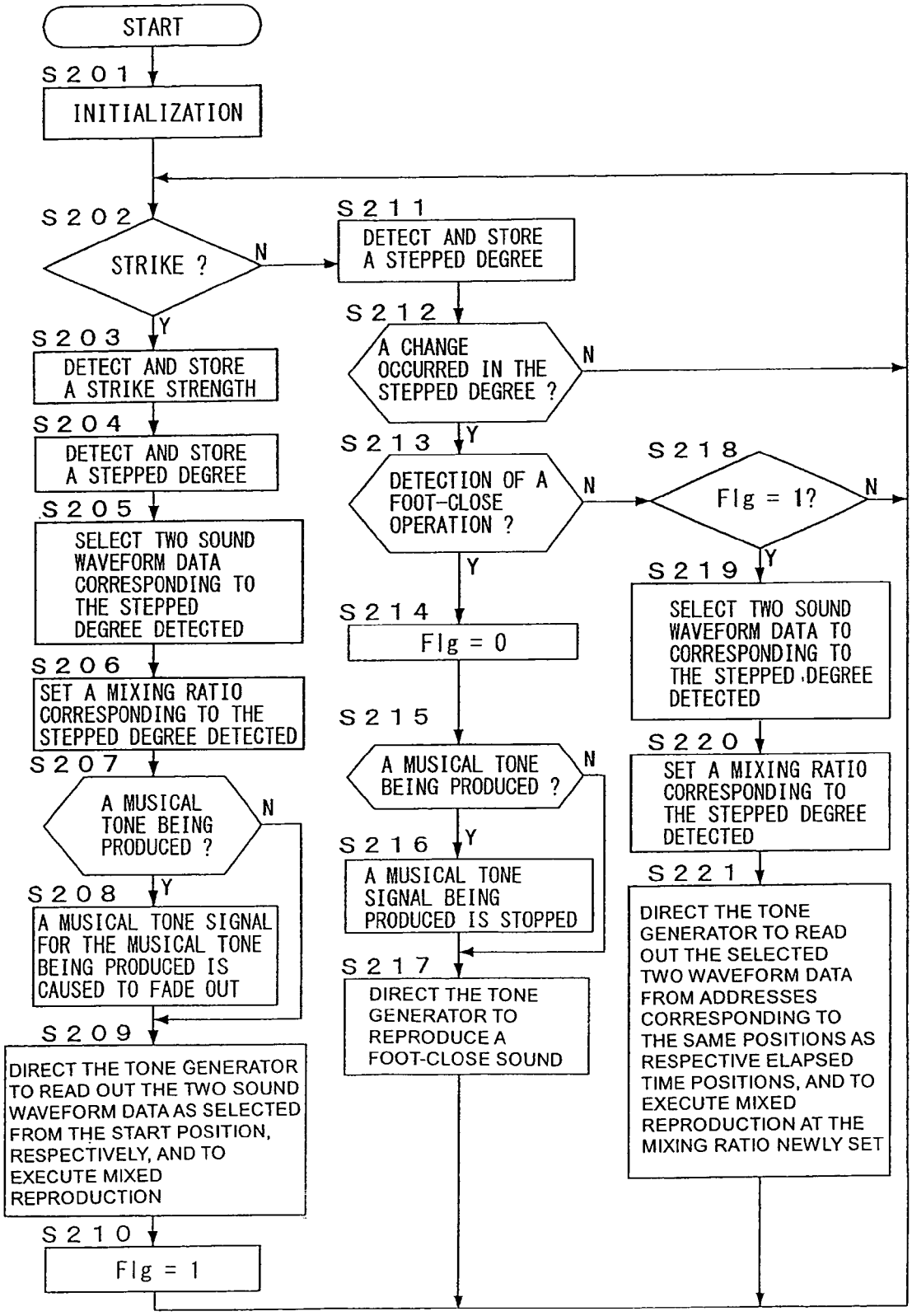

Now, referring to a flow chart in FIG. 6, a sound-produce process according to the second embodiment is described in detail hereinafter. FIG. 6 is a flow chart showing a process executed by the CPU 9 after the electronic hi-hat 1 shown in FIG. 1 is turned ON. The process shown in the flow chart indicates a process procedure by which the CPU 9 executes the process according to the program stored in a program memory 6. In the flow chart, also respective steps of the process are described as S in abbreviation.

After the electronic hi-hat 1 shown in FIG. 1 is started upon the power being turned ON, the CPU 9 starts the process in the flow chart of FIG. 6. First, in a step 201, various parameters and data are initialized. At this point in time, while respective units are initialized, the work memory 7 is caused to store initial values.

Next, the process proceeds to a step 202 to determine whether or not a strike has occurred to the hi-hat (the process in the step is the same in specific terms as that in the first embodiment). When it is determined that the strike has occurred (has been detected), the process proceeds to a step 203 where a strike strength is detected on the basis of a value of the detection signal from the strike sensor, and is stored in the work memory 7. Then, in a step 204, a stepped degree of the pedal unit 3 is detected, and is stored in the work memory 7.

Thereafter, the process proceeds to a step 205, selecting two sound waveform data corresponding to the respective stage-positions of the adjacent two stepped degrees, above and below the stepped degree detected in the step 204, and in the next step 206, a mixing ratio corresponding to the stepped degree detected is set. A process for selecting the two sound waveform data, and setting the mixing ratio will be described in detail later on.

Then, the process proceeds to a step 207 where it is checked whether or not a musical tone is being produced by a strike having occurred in the past (or foot-close sound), and when it is determined that the musical tone is being produced, the process proceeds to a step 209 for the sound-produce process after a musical tone signal for the musical tone being produced is caused to fade out in a step 208 while proceeding immediately to the step 209 when it is determined that the musical tone is not being produced.

In the step 209, the CPU 9 directs the tone generator, made up of the musical tone generating controller 10 and the waveform memory 8, to read out the two sound waveform data as selected from the start position respectively, and to mix and synthesize musical tone signals for respective musical tones of the electronic hi-hat at the mixing ratio as set, thereby causing the sound output unit to produce a musical tone (in the figure, this is paraphrased as "execute mixed reproduction" for simplification). In this case, an amplitude value is increased or decreased according to the strike strength, thereby providing the musical tone as produced with a stress. In the next step 210, a flag "F1 g", indicating that a musical tone is produced by a strike, is set to "1" (sound produced by a strike).

By the process in the steps 203 to 210, a sound-produce-start process immediately after the strike is executed, and the tone generator independently executes mixed generation of a musical tone signal, thereby causing the sound output unit 11 to continue producing a musical tone until a directive is received from the CPU 9. In the meantime, the CPU 9 reverts to the step 202 to determine whether or not a strike has occurred to the hi-hat.

Next, process steps taken when it is determined that no strike has occurred are described hereinafter. In this case, the process proceeds to a step 211 where a stepped degree is detected, and is stored in the work memory 7, and subsequently, in a step 212, the latest stepped degree as detected is compared with the stepped degree as detected at the preceding time, and stored, thereby determining whether or not any change has occurred in terms of the stage of the stepped degree on the pedal. When it is determined that no change has occurred, the process is to continue producing the present musical tone of the electronic hi-hat, reverting to the step 202.

In contrast with the case of the first embodiment, it is determined in the case of the second embodiment that the stepped degree has changed even when a slight change (owing to the resolution of an A/D converter 5) has occurred in terms of stepped-down depth of the pedal.

Then, when it is determined in the step 212 that a change has occurred to the stepped degree, the process proceeds to a step 213, checking whether or not the foot-close operation is detected. As described in the foregoing, the foot-close operation is an operation for clapping hard the upper and lower cymbals by stepping down hard the footpedal fully to the lowest position in the case of a hi-hat cymbal of the acoustic percussion instrument, and in step 213, checking is made on whether or not an operation equivalent to that is executed. No particular description as to a specific method of checking is given herein, however, there is available, for example, a method of making a determination by comparing a stepped degree that was detected in the past and stored with the latest stepped degree as detected in the step 211.

Then, when it is determined in the step 213 that the foot-close operation is detected, the sound-produce process of the foot-close sound is executed in steps 214 to 217.

First, in the step 214, the flag "F1 g" is set to "0", thereby indicating a state where the foot-close sound is being produced, and the process proceeds to the next step 215, checking whether or not a musical tone is being produced by a strike in the past. When it is determined that the musical tone is being produced, a musical tone signal for the musical tone being produced is stopped in the step 216, and the process subsequently proceeds to the step 217 where the sound-produce process of the foot-close sound is to be executed while when it is determined that the musical tone is not being produced, the process proceeds from the step 215 directly to the step 217. In the step 217, the CPU 9 directs the tone generator to read out waveform data on the foot-close sound (not particularly shown in the figure), and to generate a musical tone, thereby causing the sound output unit to produce the musical tone.

By the process in the steps 214 to 217, the sound-produce process of the foot-close sound is executed, and the tone generator executes generation of the foot-close sound, thereby causing the sound output unit 11 to continue producing the foot-close sound until a directive is received from the CPU 9. In the meantime, the CPU 9 reverts to the step 202 to determine whether or not a strike has occurred to the hi-hat.

Next, there are described process steps taken when it is determined in the step 213 that the foot-close operation is not executed. In this case, the process proceeds to a step 218, checking whether or not the flag "F1 g" is "1". When the flag "F1 g" is not "1", the process reverts to the step 202 assuming that a strike has not been detected after the initialization, or after the foot-close sound is produced. On the other hand, when the flag "F1 g" is "1", that is, when it is determined that the hi-hat is in a state that follows detection of a strike, there is executed a generation-change process for a musical tone of the electronic hi-hat through the following steps 219 to 221.

First, in the step 219, two sound waveform data corresponding to respective stage-positions of adjacent two stepped degrees, above and below, the stepped degree detected in the step 211, are selected, and in the next step 220, a mixing ratio corresponding to the latest stepped degree is newly set. Processing for the selection of the two sound waveform data, and setting of the mixing ratio will be described in detail later on. Then, in the step 221, the CPU 9 directs the tone generator to read out the two waveform data as selected from addresses corresponding to the same positions as respective elapsed time positions (respective positions from the start in time sequence) thereof, and to mix and generate musical tone signals for respective musical tones of the electronic hi-hat at the mixing ratio newly set, thereby causing the sound output unit to produce a musical tone. In this case as well, the musical tone as produced is provided with a stress according to the strike strength stored in the step 203. Thereafter, the process reverts to the step 202.

With the generation-change process for the musical tone of the electronic hi-hat being executed in the above-described steps 219 to 221, during a stepped degree after the strike being changed between the adjacent stage-positions among a plurality of the stage-positions of the stepped degrees, it is also possible to naturally change over a musical tone of the electronic hi-hat, against sound waveform data corresponding to each of the stages on a substantially continual basis, so that more natural change in the musical tone of the electronic hi-hat than for the case of the first embodiment can be presented.

Figure 7:
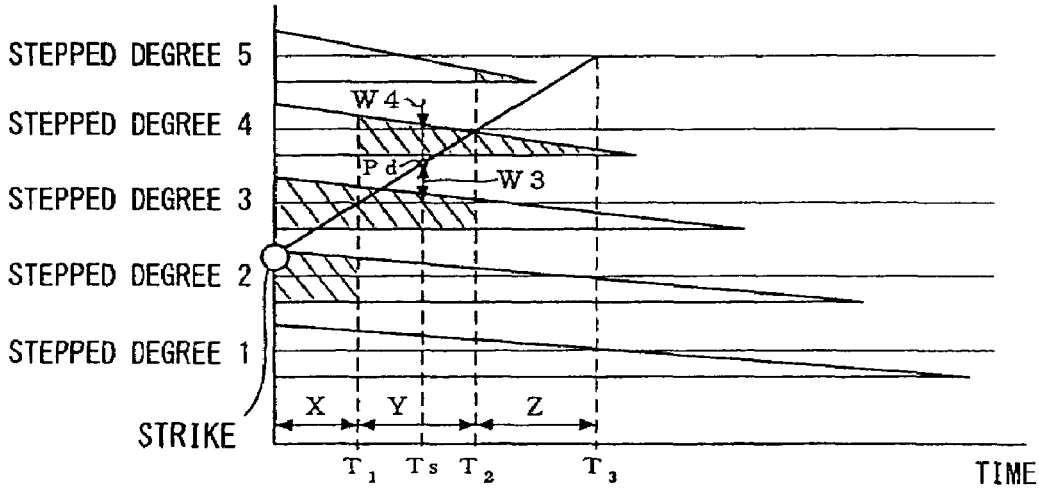
FIG. 7 is a schematic view showing a relationship between changes in stepped degree, and reproduction positions of respective sound waveforms of the electronic hi-hat, changed over according to such changes in the case of the second embodiment described in FIG. 6.
Figure 8:
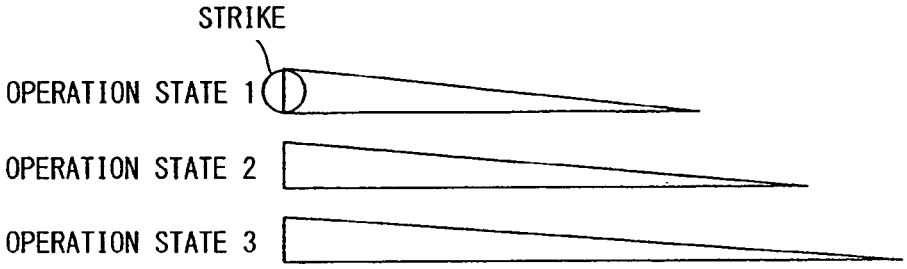
FIG. 8 PRIOR ART
FIG. 8 is a schematic view illustrating an example of controlling musical sounds produced by a conventional electronic hi-hat.
Figure 9:
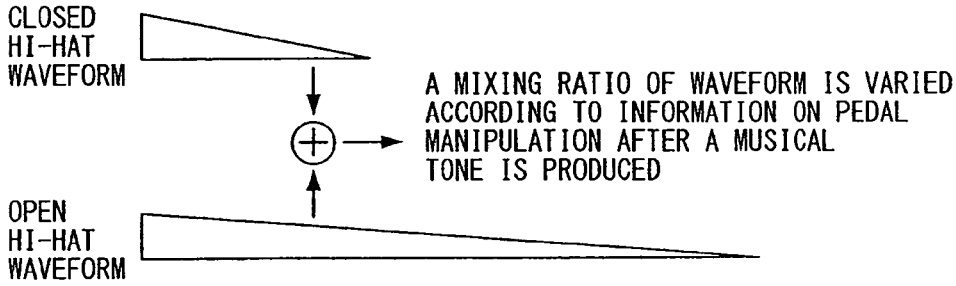
FIG. 9 PRIOR ART
FIG. 9 is a schematic view illustrating another example of controlling musical sounds produced by a conventional electronic hi-hat.

Now, respective setting methods for the mixed generation of the sound waveforms of the electronic hi-hat, according to the second embodiment, are described in detail with reference to FIG. 7. FIG. 7 is a schematic view showing a relationship between changes in stepped degree, and reproduction positions of respective sound waveforms of the electronic hi-hat, changed over according to the changes. The sound waveforms shown in FIG. 7 schematically indicate only envelope waveforms representing changes in magnitude of amplitude values.

In FIG. 7, the stepped degree is set at position points in 5 stages, and by way of example, there is shown a case where the hi-hat is first struck with the pedal stepped down between the stepped degrees 2, 3, the stepped degree undergoes a change at time $T_1$ after a lapse of X seconds to fall between the stepped degrees 3, 4, the stepped degree further undergoes a change at time $T_2$ after a lapse of Y seconds to fall between the stepped degrees 4, 5, and at time $T_3$ after a lapse of Z seconds, the stepped degree reaches a state of the stepped degree 5 that is the lowest position of the footpedal.

Against an input of detection of the stepped degree as described, during the process in the previously described step 205 immediately after the strike, and for a period of X seconds from the step 205 up to the time $T_1$ in the previously described step 219, there are selected two sound waveform data corresponding to the stepped degrees 2, 3, respectively. Subsequently, during the process for a period of Y seconds from the time $T_1$ up to the time $T_2$ in the step 219, there are selected two sound waveform data corresponding to the stepped degrees 3, 4, respectively, and further, during the process for a period of Z seconds from the time $T_2$ up to the time $T_3$ in the step 219, there are selected two sound waveform data corresponding to the stepped degrees 4, 5, respectively.

In other words, there are selected sound waveform data corresponding to a stage higher than, and the closest to (in the figure, immediately above) the stepped degree detected at that point in time, and sound waveform data corresponding to a stage lower than, and the closest to (in the figure, immediately below) the stepped degree detected at that point in time, respectively.

Further, during the process in the step 206 immediately after the strike, and for a period of X seconds from the step 206 up to the time $T_1$ in the step 220, a ratio of an interval between the stepped degree detected at that point in time, and the stepped degree 3 to an interval between the stepped degree detected at that point in time, and the stepped degree 2 is set as a mixing ratio of reproducing signals for sound waveform data corresponding to the stepped degrees 2 and 3, respectively. During the process for respective periods of Y seconds from the time $T_1$ up to the time $T_2$, and Z seconds from the time $T_2$ up to the time $T_3$ in the step 220, a mixing ratio is similarly set.

For example, as shown in FIG. 7, assuming that an interval between a detected stepped degree Pd, and the stepped degree 3, at time Ts in a period from the time $T_1$ to the time $T_2$, is defined as W3, and an interval between the detected stepped degree Pd, and the stepped degree 4, at the time Ts is defined as W4, a reproducing signal for sound waveform data corresponding to the stepped degrees 3 is mixed at a ratio of W4/(W3+W4) against a musical tone of the electronic hi-hat as finally produced, and a reproducing signal for sound waveform data corresponding to the stepped degrees 4 is mixed at a ratio of W3/(W3+W4) against the musical tone of the electronic hi-hat as finally produced.

Thus, by selecting the two sound waveform data, and setting the respective mixing ratios thereof, even in the middle of the stepped degree detected after the strike being changed between the two adjacent stages, musical tones of the electronic hi-hat, corresponding to the two sound waveform data, can be naturally changed over on a substantially continual basis, and furthermore, it is possible to faithfully reproduce even a delicate change in the stepped degree between the two adjacent stages. The above-described setting method for the mixing ratio is shown by way of example, and the mixing ratio may be set by other methods.

Further, when changing over among the sound waveform data selected at the respective times $T_1$, $T_2$, $T_3$, reproduction positions are designated such that newly selected sound waveform data are read from addresses corresponding to the times $T_1$, $T_2$, $T_3$, that is, respective elapsed times at that point in time, in time sequence. Further, when changing over among the sound waveform data, designation of new reproduction positions may be executed by designation of the positions such that the sound waveforms are dynamically connected with each other at positions where the amplitude envelope value is identical, as described with reference to the first embodiment. When the stepped degree detected coincides with one of positions set for the respective stages of the stepped degrees 1 to 5, there will be reproduced a musical tone of the electronic hi-hat, corresponding to only one sound waveform data corresponding to the relevant stage as in the case of the first embodiment.

Further, with the second embodiment as well, various changes are similarly possible as with the first embodiment.

With each of the two embodiments of the invention that have been described hereinbefore, the musical tones are outputted after increasing or decreasing the amplitudes values of the musical tone signals generated according to a strike strength. It is to be pointed out, however, that the invention is not limited thereto, and that the musical tones may be outputted according to parameters other than the strike strength, or the musical tones may be outputted always at the same amplitudes value upon receiving a strike without increasing or decreasing the amplitudes values, as described.

Furthermore, the electronic hi-hat sound waveform data is not limited to sound waveform data obtained by sampling actual strike sound waveforms of a hi-hat cymbal of the acoustic percussion instrument. as described in the foregoing, however, the electronic hi-hat sound waveform data may be prepared by artificially synthesizing the same, or by working on the sound waveform data obtained by sampling the actual strike sound waveforms of the hi-hat cymbal.

INDUSTRIAL APPLICABILITY

The invention can be applied to an electronic hi-hat cymbal used in the electronic drum set, and because sound waveforms of the electronic hi-hat can be naturally changed over in real time response to a change in stepped degree, due to manipulation of the pedal, it becomes possible to present a subtle and realistic performance finely expressing the intention of a performer.

What is claimed is:

1. An electronic hi-hat cymbal comprising a hi-hat having a strike detector for detecting a strike, a pedal unit having a stepped degree detector for detecting a stepped degree of a pedal, a waveform data memory for storing a plurality of electronic hi-hat sound waveform data, corresponding to the respective stepped degrees, in a plurality of stages, detectable by the stepped degree detector, and a musical tone generator;

wherein the musical tone generator reads out electronic hi-hat sound waveform data corresponding to a stepped degree detected by the stepped degree detector from the waveform data memory when a strike is detected by the strike detector to thereby generate a musical tone signal before outputting, and in the case where a change occurs to the stepped degree detected by the stepped degree detector during a musical tone being produced thereafter, the musical tone generator reads out electronic hi-hat sound waveform data corresponding to a new stepped degree halfway through to thereby generate a musical tone signal before outputting.

2. An electronic hi-hat cymbal according to claim 1, wherein the sound waveform of the electronic hi-hat is a sound waveform with an amplitude envelope value decreasing in time sequence; and wherein the musical tone generator reads out the electronic hi-hat sound waveform data from the start thereof when the electronic hi-hat sound waveform data are read out for the first time from the waveform data memory upon the detection of the strike, and the musical tone generator reads out electronic hi-hat sound waveform data corresponding to a new stepped degree from an address of an amplitude envelope value corresponding to an amplitude envelope value of a sound waveform of the electronic hi-hat, being read at that point in time, when a change occurs to the stepped degree during a musical tone being produced thereafter.

3. An electronic hi-hat cymbal according to claim 1, wherein the sound waveform of the electronic hi-hat is a sound waveform with an amplitude envelope value decreasing in time sequence; and wherein the musical tone generator reads out the electronic hi-hat sound waveform data from the start thereof when the electronic hi-hat sound waveform data are read out for the first time from the waveform data memory upon the detection of the strike, and the musical tone generator reads out electronic hi-hat sound waveform data corresponding to a new stepped degree from an address at the same position from the start in time sequence, being read at that point in time, when a change occurs to the stepped degree during a musical tone being produced thereafter.

4. An electronic hi-hat cymbal according to claim 1, wherein the musical tone generator causes the musical tone signal to fade out, and causes a musical tone signal according to newly read electronic hi-hat sound waveform data to fade in, thereby mixing it therewith before outputting, when a change occurs to the stepped degree during a musical tone signal being outputted.

5. An electronic hi-hat cymbal according to claim 2, wherein the musical tone generator causes the musical tone signal to fade out, and causes a musical tone signal according to newly read electronic hi-hat sound waveform data to fade in, thereby mixing it therewith before outputting, when a change occurs to the stepped degree during a musical tone signal being outputted.

6. An electronic hi-hat cymbal according to claim 3, wherein the musical tone generator causes the musical tone signal to fade out, and causes a musical tone signal according to newly read electronic hi-hat sound waveform data to fade in, thereby mixing it therewith before outputting, when a change occurs to the stepped degree during a musical tone signal being outputted.

7. An electronic hi-hat cymbal according to claim 1, wherein the musical tone generator reads out two sound waveform data corresponding to respective stepped degrees of the two adjacent stages, and mixes respective musical tone signals according to the two sound waveform data at a mixing ratio corresponding to the stepped degree detected before being outputted, if the stepped degree detected by the stepped degree detector falls between two adjacent stages among the plurality of stages.

8. An electronic hi-hat cymbal according to claim 2, wherein the musical tone generator reads out two sound waveform data corresponding to respective stepped degrees of the two adjacent stages, and mixes respective musical tone signals according to the two sound waveform data at a mixing ratio corresponding to the stepped degree detected before being outputted, if the stepped degree detected by the stepped degree detector falls between two adjacent stages among the plurality of stages.

9. An electronic hi-hat cymbal according to claim 3, wherein the musical tone generator reads out two sound waveform data corresponding to respective stepped degrees of the two adjacent stages, and mixes respective musical tone signals according to the two sound waveform data at a mixing ratio corresponding to the stepped degree detected before being outputted,. if the stepped degree detected by the stepped degree detector falls between two adjacent stages among the plurality of stages.

10. An electronic hi-hat cymbal according to claim 1, wherein the strike detector is capable of detecting a strike strength as well, and the musical tone generator generates a musical tone signal by increasing or decreasing amplitude value of the sound waveform of the electronic hi-hat as read out, according to the strike strength detected by the strike detector.

11. An electronic hi-hat cymbal according to claim 1, wherein the stepped degree of a pedal, detected by the stepped degree detector, is caused to correspond to an opening degree between two cymbals of a hi-hat cymbal of an acoustic percussion instrument, and the plurality of the electronic hi-hat sound waveform data stored in the waveform data memory is caused to be electronic hi-hat sound waveform data equivalent to hi-hat strike sounds corresponding to the respective opening degrees between the two cymbals.

* * * * *